US010222751B2

(12) United States Patent
Robin

(10) Patent No.: US 10,222,751 B2
(45) Date of Patent: Mar. 5, 2019

(54) CALENDAR MECHANISM

(71) Applicant: Blancpain SA, Le Brassus (CH)

(72) Inventor: Martin Robin, Geneva (CH)

(73) Assignee: Blancpain SA, Le Brassus (CH)

( * ) Notice: Subject to any disclaimer, the term of this patent is extended or adjusted under 35 U.S.C. 154(b) by 0 days.

(21) Appl. No.: 15/834,101

(22) Filed: Dec. 7, 2017

(65) Prior Publication Data

US 2018/0173164 A1 Jun. 21, 2018

(30) Foreign Application Priority Data

Dec. 21, 2016 (EP) ..... 16205926

(51) Int. Cl.
*G04B 19/253* (2006.01)

(52) U.S. Cl.
CPC ..... *G04B 19/2536* (2013.01); *G04B 19/2532* (2013.01)

(58) Field of Classification Search
CPC ..... G04B 19/2532; G04B 19/2536; G04B 19/2538; G04B 19/247; G04B 19/257–19/2578
USPC ..... 368/37
See application file for complete search history.

(56) References Cited

U.S. PATENT DOCUMENTS 7,102,962 B2 * 9/2006 Suzuki ..... G04B 19/247 368/37
7,110,326 B2 * 9/2006 Besse ..... G04B 19/247 368/37
7,532,546 B2 5/2009 Suzuki et al.
7,724,611 B2 * 5/2010 Groothuis ..... G04B 19/247 368/223
9,733,619 B2 * 8/2017 Rombach ..... G04B 19/247
2007/0047391 A1 3/2007 Suzuki et al.

FOREIGN PATENT DOCUMENTS

EP 1 962 153 A1 8/2008

OTHER PUBLICATIONS

European Search Report dated Jun. 29, 2017 in European Application 16205926.5, filed on Dec. 21, 2016 ( with English Translation of Categories of Cited Documents ).

* cited by examiner

*Primary Examiner* — Edwin A. Leon
*Assistant Examiner* — Jason M Collins
(74) *Attorney, Agent, or Firm* — Oblon, McClelland, Maier & Neustadt L L P

(57) ABSTRACT

A calendar mechanism including date-discs, a date program unit, a drive unit that drives the date program unit and a drive member for actuating the drive unit. The date-discs include a first lower units disc and a second upper units disc, and a third lower tens disc and a fourth upper tens disc. The date program unit includes date program wheel sets for actuating the date-discs and arranged to mesh selectively with the date-discs so that the last day of the month is displayed with the third lower tens disc and the first upper units disc, and the first day of the following month is displayed with the fourth upper tens disc and the second upper units disc, the change of date between two consecutive months occurring via a single jump of the fourth upper tens disc and of the second upper units disc, regardless of the month. The mechanism may include a month wheel set and a leap-year adjustment mechanism arranged to cooperate with the drive unit, the drive unit being a month program wheel.

15 Claims, 6 Drawing Sheets

CALENDAR MECHANISM

This application claims priority from European Patent Application No. 16205926.5 filed on Dec. 21, 2016; the entire disclosure of which is incorporated herein by reference.

FIELD OF THE INVENTION

The invention relates to a calendar mechanism for a timepiece comprising a date display by means of date-discs, a date programme unit arranged to drive the date-discs in determined sequences, a drive unit arranged to drive the date programme unit and a drive member of the timepiece arranged to actuate the drive unit. The present invention also relates to a timepiece comprising such a calendar mechanism.

BACKGROUND OF THE INVENTION

A calendar mechanism of this type is described, for example, in U.S. Pat. No. 7,532,546. This calendar mechanism comprises, in particular, a tens disc bearing the numerals 0 to 3, and two units discs, an upper disc bearing the numerals 0 to 4, and a lower disc bearing the numerals 5 to 9. Due to this arrangement, the change of date from the 28th to the 29th February or at the end of months of 30 days requires one or more intermediate jumps of one or both discs to display the first day of the following month. This therefore leads to a lack of precision in the calendar display as the date changes.

Further, the date is displayed by means of a tens disc and a units disc which are on two different levels on 15 out of 31 days, i.e. close to half the month. This difference in height between the units numeral and the tens numeral gives an unattractive visual appearance. Further, as the date changes, especially from the 31st to the 1st, only the tens disc moves so that the change of date is not clearly displayed.

There are also continuous-type calendar mechanisms, but they have the drawback of leaving the date display imprecise for a certain time as the date changes, and especially as the month changes.

SUMMARY OF THE INVENTION

It is an object of the invention to overcome the various drawbacks of known devices.

More precisely, it is an object of the invention to provide a calendar mechanism offering high precision as the date changes, particularly as the month changes, and more particularly on the 28th or 29th of February or at the end of months of 30 days.

It is also an object of the invention to provide a calendar mechanism having an improved visual appearance, which gives the impression of a date formed of two numerals that are part of the same structure.

To this end, the present invention concerns a calendar mechanism for a timepiece comprising a date display by means of date-discs, a date programme unit arranged to drive the date-discs in determined programmed sequences, a drive unit arranged to drive the date programme unit and a drive member of the timepiece arranged to actuate the drive unit.

According to the invention, the date-discs comprise, on the one hand, a first lower units disc and a second upper units disc which are superposed and free to rotate with respect to each other and, on the other hand, a third lower tens disc and a fourth upper tens disc, which are superposed and free to rotate with respect to each other, the first lower units disc being divided into eight sectors occupied by the numerals 8, 9, 0 and 1, the second upper units disc being divided into eight sectors, of which seven sectors are occupied by the numerals from 1 to 7 and one sector is occupied by an aperture revealing one of the numerals borne by the first lower units disc, the third lower tens disc being divided into eight sectors occupied by the numerals 2 and 3, the fourth upper tens disc being divided into eight sectors, of which seven sectors are occupied by the numerals 0, 1 and 2 and one sector is occupied by an aperture revealing one of the numerals borne by the third lower tens disc, the date programme unit comprising a first date programme wheel set for actuating the first lower units disc and the third lower tens disc, and a second date programme wheel set for actuating the second upper units disc and the fourth upper tens disc, said first and second date programme wheel sets being arranged to mesh selectively with the date-discs so that the last day of a month is displayed by means of the third lower tens disc and the first lower units disc and the first day of the following month is displayed by means of the fourth upper tens disc and the second upper units disc, the change of date between two consecutive months, and thus the display of the first day of the month, occurring by means of a single jump of the fourth upper tens disc and of the second upper units disc, regardless of the month.

Thus, the calendar mechanism according to the invention offers a very precise display of the date as the month changes.

Moreover, the calendar mechanism according to the invention provides a date display wherein the tens numeral and the units numeral are on the same level for 25 out of 31 days. This makes it possible to obtain a very attractive calendar display, particularly suitable for a large date display.

According to a first variant, the calendar mechanism of the invention further comprises a month wheel set and a leap-year adjustment mechanism for cooperating with the drive unit, said drive unit comprising a month programme wheel, so that the calendar mechanism is a perpetual calendar mechanism.

According to another variant of the invention, the leap-year adjustment mechanism is arranged to cooperate with a leap-year programme wheel until at least 2300, so that the calendar mechanism is a secular perpetual calendar mechanism.

The present invention also concerns a timepiece comprising a calendar mechanism as defined above.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF A PREFERRED EMBODIMENT

The description that follows concerns, firstly, a perpetual calendar mechanism, particularly suitable for a large date display, with reference to FIGS. 1 to 10, and then a secular perpetual calendar mechanism, also particularly suitable for a large date display.

Figure 1:
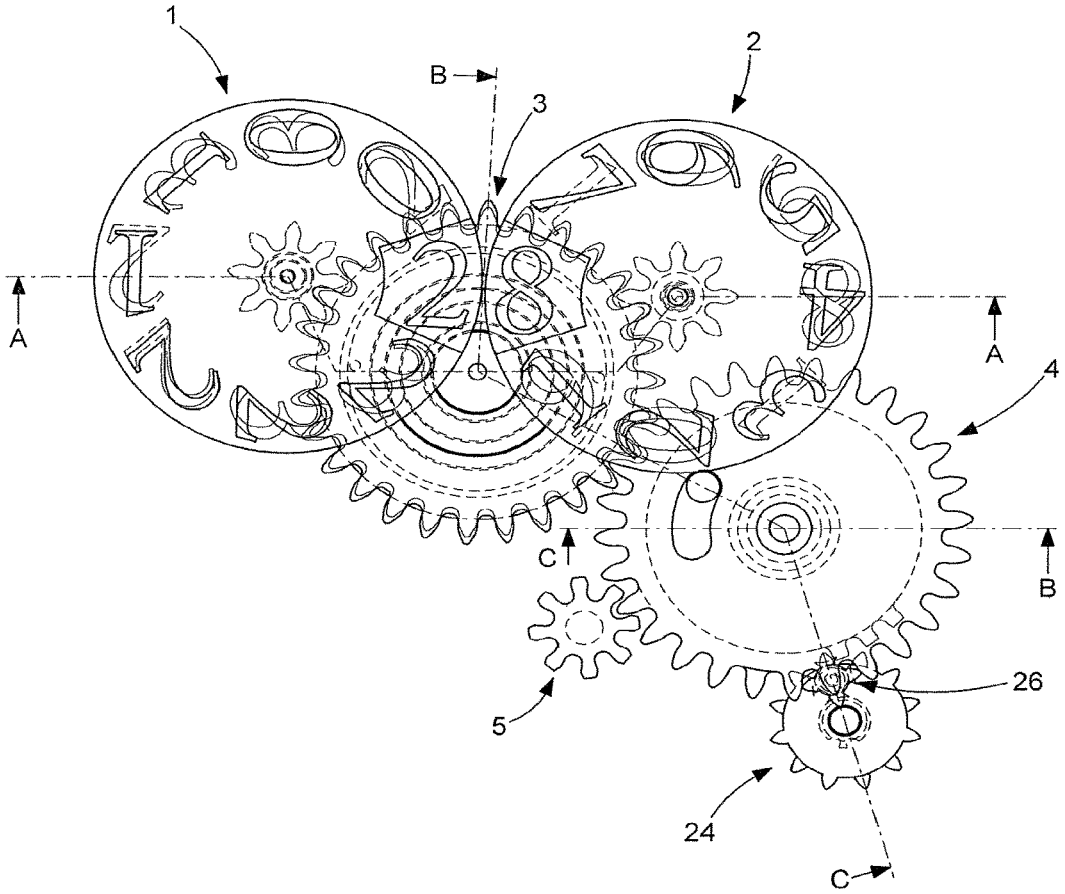
FIG. 1 is a top view of a first variant of the calendar mechanism according to the invention.

Referring to FIG. 1, there is represented a calendar mechanism for a timepiece comprising a calendar display that is particularly suitable for a large date display. The date is composed by means of date-discs 1, 2 and more particularly by the combination of a tens numeral borne by a tens disc and a units numeral borne by a units disc. In a known manner, the date appears through two wide apertures arranged in the dial and placed side by side. The date-discs are driven by a date programme unit 3 arranged to actuate the date-discs in programmed sequences, so that the days of the month appear in succession in the apertures. The date programme unit 3 is driven by a drive unit 4, which is itself actuated by a drive member 5 powered by the timepiece movement.

According to the invention, and referring more particularly to FIGS. 2 to 6, there are four date-discs which comprise on the one hand, a first lower units disc 2*a* and a second upper units disc 2*b* which are superposed, coaxially mounted and free to rotate with respect to one another, and, on the other hand, a third lower tens disc 1*a* and a fourth upper tens disc 1*b*, which are superposed, coaxially mounted and free to rotate with respect to one another. The second upper units disc 2*b* is integral with a units arbor 6*b* that also carries a pinion 10*b*, which is consequently integral with second upper units disc 2*b*. First lower units disc 2*a* is integral with a units arbor 6*a* that also carries a pinion 10*a*, which is consequently integral with first lower units disc 2*a*. Units arbor 6*a* is coaxially mounted to rotate freely about units arbor 6*b*. Likewise, fourth upper tens disc 1*b* is integral with a tens arbor 8*b* that also carries a pinion 12*b*, which is consequently integral with said fourth upper tens disc 1*b*. Third lower tens disc 1*a* is integral with a tens arbor 8*a* that also carries a pinion 12*a*, which is consequently integral with said third lower tens disc 1*a*. Tens arbor 8*a* is coaxially mounted to rotate freely about tens arbor 8*b*.

Figure 3:
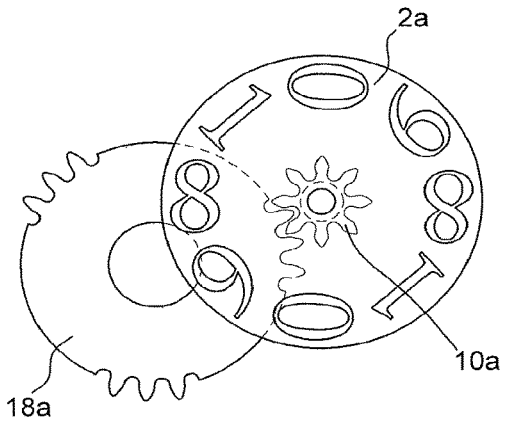
FIG. 3 is a top view showing the first lower units disc with its lower units wheel.
Figure 4:
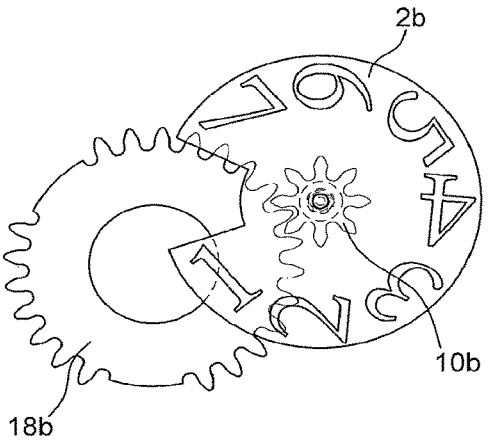
FIG. 4 is a top view showing the second upper units disc with its upper units wheel.

As shown in FIG. 3, first lower units disc 2*a* is divided into eight regular sectors occupied by the numerals 8, 9, 0 and 1, forming the sequence 8, 9, 0, 1, 8, 9, 0, 1. As shown in FIG. 4, second upper units disc 2*b* is divided into eight regular sectors, of which seven sectors are occupied by the numerals from 1 to 7, forming the sequence 1, 2, 3, 4, 5, 6, 7, and one sector is occupied by an aperture that reveals one of the numerals borne by first lower units disc 2*a*, when the first and second units discs 2*a*, 2*b* are superposed.

Figure 5:
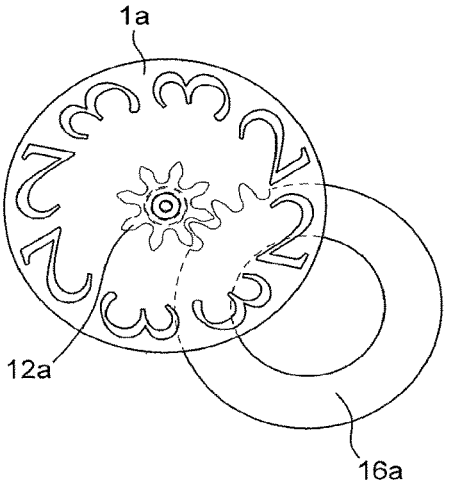
FIG. 5 is a top view showing the third lower tens disc with its lower tens wheel.
Figure 6:
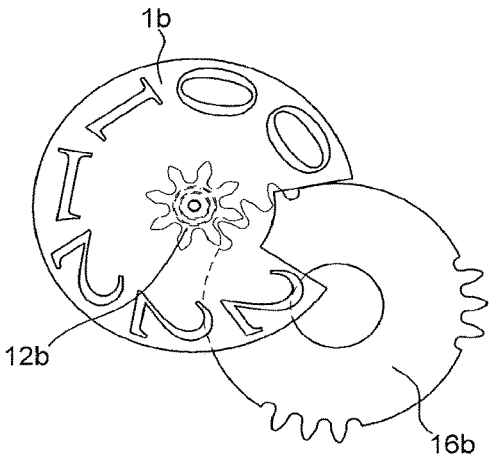
FIG. 6 is a top view showing the fourth upper tens disc with its upper tens wheel.

As shown in FIG. 5, third lower tens disc 1*a* is divided into eight regular sectors occupied by the numerals 2 and 3, forming the sequence 2, 2, 3, 3, 2, 2, 3, 3. As shown in FIG. 6, fourth upper tens disc 1*b* is divided into eight regular sectors, of which seven sectors are occupied by the numerals 0, 1 and 2, forming the sequence 0, 0, 1, 1, 2, 2, 2, and one sector is occupied by an aperture that reveals one of the numerals borne by third lower tens disc 1*a*, when the third and fourth tens discs 1*a*, 1*b* are superposed.

Date discs 1*a*, 1*b*, 2*a*, 2*b* are driven by date programme unit 3, which comprises a first date programme wheel set 3*a* for actuating first lower units disc 2*a* and third lower tens disc 1*a*, and a second date programme wheel set 3*b* for actuating second upper units disc 2*b* and fourth upper tens disc 1*b*.

Figure 2:
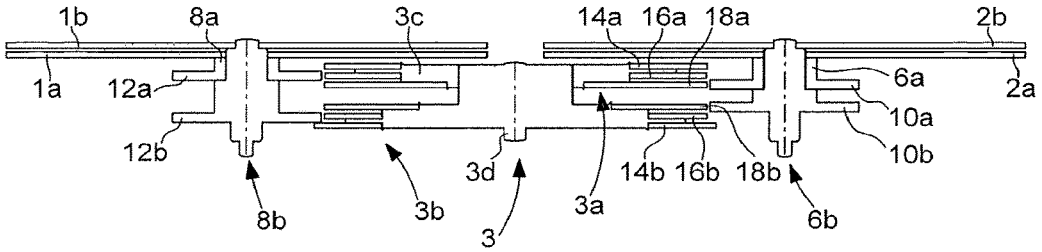
FIG. 2 is a cross-sectional view along line A-A of FIG. 1.

More particularly referring to FIGS. 2, 3 and 5, first date programme wheel set 3*a* comprises a first date drive wheel 14*a* that meshes at least indirectly with drive unit 4, as will be seen below, a lower tens wheel 16*a* that meshes at least indirectly with pinion 12*a* integral with third lower tens disc 1*a* and a lower units wheel 18*a* that meshes at least indirectly with pinion 10*a* integral with first lower units disc 2*a*. First date drive wheel 14*a*, lower tens wheel 16*a* and lower units wheel 18*a* are mounted superposed and joined together on an arbor 3*c*.

More particularly referring to FIGS. 2, 4 and 6, second date programme wheel set 3*b* comprises a second date drive wheel 14*b* that meshes at least indirectly with drive unit 4, as will be seen below, an upper tens wheel 16*b* that meshes at least indirectly with pinion 12*b* integral with fourth upper tens disc 1*b* and an upper units wheel 18*b* that meshes at least indirectly with pinion 10*b* integral with second upper units disc 2*b*. Second date drive wheel 14*b*, upper tens wheel 16*b* and upper units wheel 18*b* are mounted superposed and joined together on an arbor 3*d*. Arbor 3*c* is pivotally and coaxially mounted on arbor 3*d*.

The first 3*a* and second 3*b* date programme wheel sets are arranged to mesh selectively with date-discs 1*a*, 1 *b*, 1*c*, 1*d* so that the last day of the month is displayed by means of third lower tens disc 1*a* and first lower units disc 2*a* and the first day of the following month is displayed by means of fourth upper tens disc 1*b* and second upper units disc 2*b*, the change of date between two consecutive months, and thus the display of the first day of the month, occurring by means of a single jump of fourth upper tens disc 1*b* and of second upper units disc 2*b*, regardless of the month.

To this end, lower tens wheel 16*a*, upper tens wheel 16*b*, lower units wheel 18*a*, and upper units wheel 18*b*, which are driven one step per day by drive unit 4, comprise toothings whose number and distribution of teeth are selected to form drive sectors for pinions 12*a*, 12*b*, 10*a*, 10*b* and thus for the associated date-discs 1*a*, 1*b*, 2*a*, 2*b*, or waiting positions in which the date-discs are locked, so that the 1st to the 7th, the 11th to the 17th and the 21st to the 27th days of the month are displayed by means of fourth upper tens disc 1*b* and second upper units disc 2*b*, the 8th, 9th, 10th, 18th, 19th and 20th days of the month are displayed by means of fourth upper tens disc 1*b* and first lower units disc 2*a*, and the 28th, 29th, 30th and 31st days of the month are displayed by means of third lower tens disc 1*a* and first lower units disc 2*a*.

Lower tens wheel 16*a* and lower units wheel 18*a* are driven by means of first date drive wheel 14*a*, which cooperates with drive unit 4, and upper tens wheel 16*b* and upper units wheel 18*b* are driven by means of second date drive wheel 14*b*, which cooperates with drive unit 4.

Figure 7:
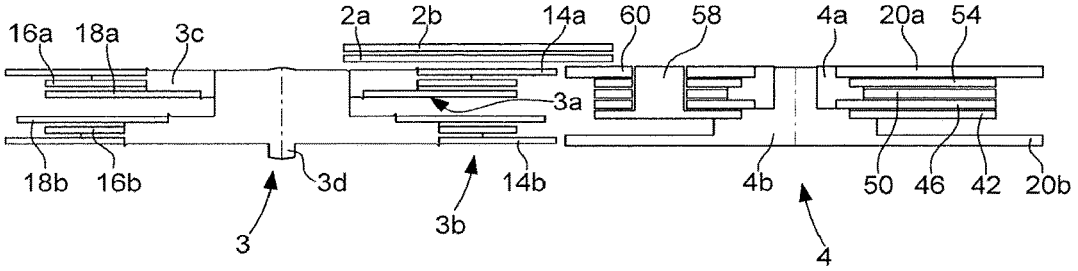
FIG. 7 is a cross-sectional view along line B-B of FIG. 1.
Figure 9:
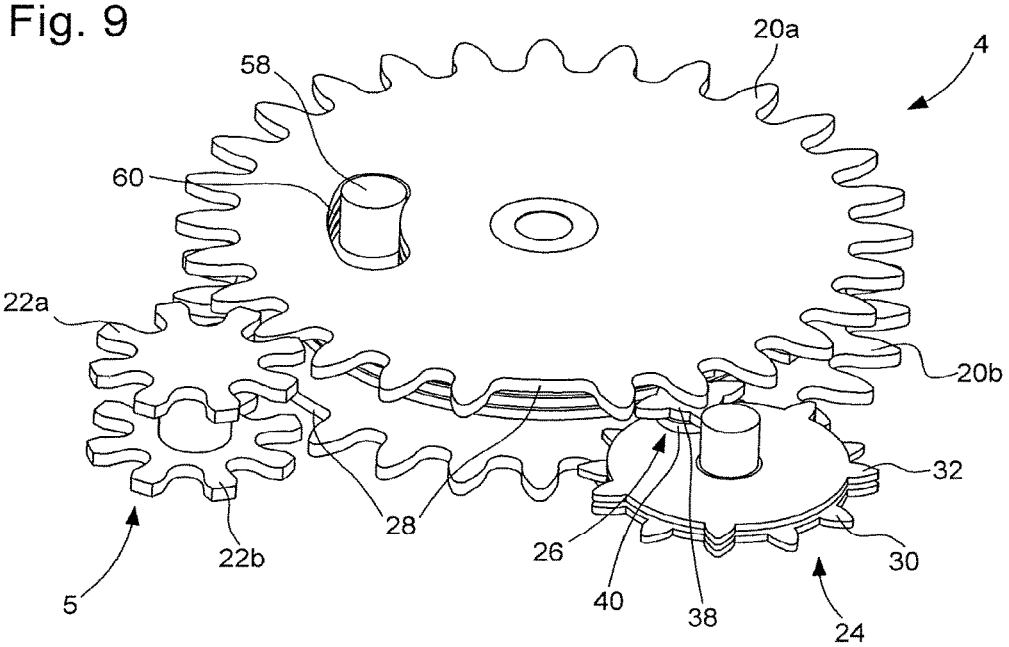
FIG. 9 is an isometric top view of the drive unit, of the drive member, of the month wheel set and of the leap-year adjustment mechanism.

More particularly referring to FIG. 7, drive unit 4 comprises a first drive wheel 20*a* arranged to drive first date programme wheel set 3*a* and a second drive wheel 20*b* arranged to drive second date programme wheel set 3*b*. Drive member 5 comprises a first drive pinion 22*a* meshing with first drive wheel 20*a* and a second drive pinion 22*b* meshing with second drive wheel 20*b*, as represented in FIG. 9. Drive pinions 22*a* and 22*b* are coaxial and integral with each other. They are powered by the movement with which they cooperate in order to actuate the first and second drive wheels 20*a*, 20*b* once per day.

The drive unit may have no complications, with any correction of the date at the end of the month being made manually by the user.

However, according to a particularly advantageous embodiment, drive unit 4 takes the form of a month programme wheel incorporating first and second drive wheels 20*a*, 20*b*, and the calendar mechanism also comprises a month wheel set 24 and a leap-year adjustment mechanism 26 arranged to cooperate with drive unit 4, so that the calendar mechanism according to the invention is a perpetual calendar mechanism. Month wheel set 24 carries a disc or any other month display member.

Referring more particularly to FIG. 9, first drive wheel 20*a*, respectively second drive wheel 20*b*, has 28 teeth, one of which is missing to form a notch 28 defining a waiting position in which first drive wheel 20*a*, respectively second drive wheel 20*b*, is not driven by drive member 5. Notch 28 provided on first drive wheel 20*a* is positioned after the teeth corresponding to the 28th, 29th, 30th and 31st days of the month and notch 28 provided on second drive wheel 20*b* corresponds to the position of second drive wheel 20*b* on the 28th of the month.

Figure 8:
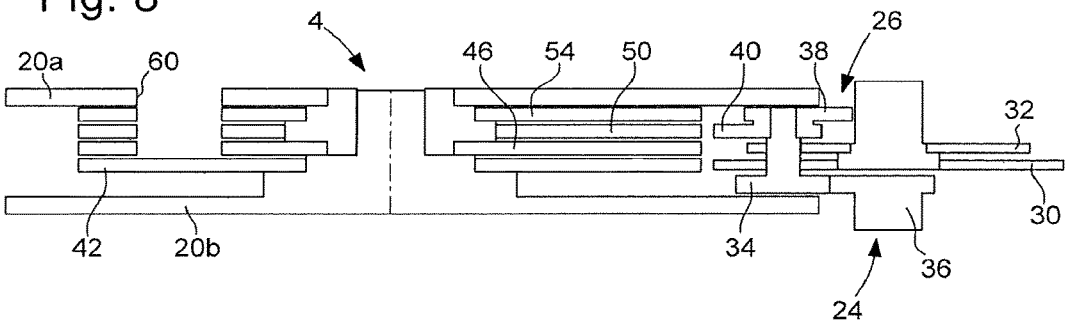
FIG. 8 is a cross-sectional view along line C-C of FIG. 1.
Figure 10:
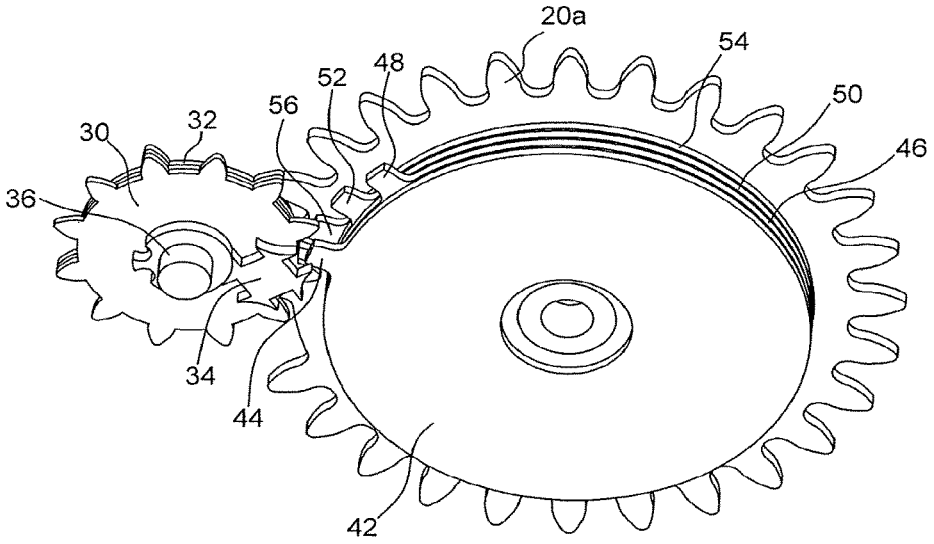
FIG. 10 is an isometric bottom view of the drive unit, and of the month wheel set.

Referring more particularly to FIGS. 8 to 10, month wheel set 24 comprises a month wheel 30 with 12 teeth corresponding to the 12 months of the year, integral with a 30-day month wheel 32 comprising 4 teeth arranged to correspond to the months of 30 days: April, June, September and November. Month wheel 30 and 30-day month wheel 32 are disposed so that their teeth are superposed, i.e. are disposed in the same alignment.

Leap-year adjustment mechanism 26 and a Maltese cross 34 integral in rotation with said leap-year adjustment mechanism 26 are mounted to pivot on month wheel set 24, and Maltese cross 34 is actuated by a fixed finger 36 arranged on the frame and about which said Maltese cross 34, carried by month wheel set 24, rotates. Maltese cross 34 and fixed finger 36 are arranged such that Maltese cross 34 slides over the periphery of fixed finger 36 when month wheel set 24 turns, and so that Maltese cross 34 makes a quarter-turn when it passes in front of fixed finger 36 to cause leap-year adjustment mechanism 26 to pivot a quarter-turn.

In this variant, leap-year adjustment mechanism 26 is a leap-year wheel set that comprises a non-leap-year wheel 38 and a leap-year wheel 40 which are superposed and integral with each other. Non-leap-year wheel 38 has 3 fingers arranged at 90° to form a cross, one arm of which is missing and leap-year wheel 40 has a single finger disposed underneath the space corresponding to the missing branch of non-leap-year wheel 38. Leap-year adjustment wheel set 26 and thus Maltese cross 34 are placed on month wheel set 24 such that the fingers of non-leap-year wheel 38 and leap-year wheel 40 correspond to the February tooth of month wheel 30 of month wheel set 24. The fingers of non-leap-year wheel 38 and leap-year wheel 40 are arranged to cooperate with drive unit 4, as will be described below.

Drive unit 4 or the month programme wheel comprise, in addition to the first 20*a* and second 20*b* drive wheels which respectively mesh with first date drive wheel 14*a* of first date programme wheel set 3*a* and second date drive wheel 14*b* of second date programme wheel set 3*b*, a month change wheel 42 comprising a tooth 44 arranged to mesh with month wheel 30 of month wheel set 24, a 30-day wheel referenced 46 carrying a tooth 48 arranged to be able to mesh with 30-day month wheel 32, a 29-day wheel referenced 50 carrying a tooth 52 arranged to be able to mesh with the finger of leap-year wheel 40 of leap-year adjustment wheel set 26, and a 28-day wheel referenced 54 carrying a tooth 56 arranged to be able to mesh with a finger of non leap-year wheel 38 of leap-year adjustment wheel set 26. The 28-day, 29-day and 30-day wheels are disposed such that tooth 52 of the 29-day wheel referenced 50 is shifted by one step with respect to tooth 56 of the 28-day wheel referenced 54, and tooth 48 of the 30-day wheel 46 is shifted by one step with respect to tooth 52 of the 29-day wheel referenced 50.

Month change wheel 42 is joined to second drive wheel 20*b* via a drive arbor 4*b* of second drive wheel 20*b*. The 30-day wheel referenced 46, the 29-day wheel referenced 50, the 28-day wheel referenced 54 and first drive wheel 20*a* are joined to each other via a drive arbor 4*a* pivotally mounted on drive arbor 4*b*.

Month change wheel 42 carries a pin 58 towards first drive wheel 20*a*. The 30-day wheel referenced 46, 29-day wheel referenced 50, 28-day wheel referenced 54 and first drive wheel 20*a* each have an oblong aperture 60 called an eye which is arranged to receive pin 58 of month change wheel 42 and inside which said pin 58 can move when the motion of second drive wheel 20*b* is different from the motion of first drive wheel 20*a*, as will be described below.

The 28-day wheel referenced 54 is arranged with respect to month change wheel 42 such that on the 28th day of the month, tooth 56 of 28-day wheel 54 is aligned with tooth 44 of month change wheel 42, with said teeth 44 and 56 arriving at the level of month wheel set 24 and of leap-year adjustment wheel set 26.

The calendar mechanism operates as follows: from the 5th to the 28th days of the month, none of teeth 44, 48, 52, 56 of wheels 42, 46, 50 and 54 respectively are positioned at the level of month wheel set 24 and of leap-year adjustment wheel set 26, which remain stationary, and the first 20*a* and second 20*b* drive wheels advance together at the same speed, at a rate of one step per day, respectively driven by drive pinions 22*a* and 22*b*. Pin 58 of month change wheel 42 is positioned at the front of eye 60 in the direction of rotation of the wheels of drive unit 4. The first 20*a* and second 20*b* drive wheels respectively drive first date drive wheel 14*a* of first date programme wheel set 3*a* and second date drive wheel set 14*b* of second date programme wheel set 3*b*, so that each of the first 3*a* and second 3*b* date programme wheel sets is in motion. Thus, lower tens wheel 16*a*, upper tens wheel 16*b*, lower units wheel 18*a*, and upper units wheel 18*b* of date programme unit 3 drive the associated date-discs 1*a*, 1*b*, 2*a* and 2*b* in accordance with the sequence programmed by the number and arrangement of the wheel teeth of date programme unit 3 described above.

On the 28th of every month, tooth 56 of 28-day wheel 54 is aligned with tooth 44 of month change wheel 42, with said teeth 56 and 44 arriving at the level of month wheel set 24 and of leap-year adjustment wheel set 26. Pin 58 of month change wheel 42 is still positioned at the front of eye 60. Further, notch 28 of second drive wheel 20*b* arrives at the level of drive pinion 22*b* so that the latter no longer drives said second drive wheel 20*b*, or, consequently, month change wheel 42. Tooth 44 and pin 58 are thus henceforth stationary. Since second drive wheel 20*b* is stopped in the waiting position, second date programme wheel set 3*b* is also stopped, so that the following days of the month, until the last day of the month, will be displayed by means of third lower tens disc 1*a* and first lower units disc 2*a* driven by the first date programme wheel set 3*a*, which is the only one driven by drive unit 4.

If the current month is a month of 30 days, month wheel set 24 is positioned such that leap-year adjustment wheel set 26 is remote from teeth 52 and 56, and so that one of the teeth of 30-day month wheel 32 and one tooth of month wheel 30 can cooperate with tooth 48 and tooth 44 respectively. From the 28th of the month, second drive wheel 20*b*, month change wheel 42 and its tooth 44 and pin 58 are stopped as described above. Under the action of drive pinion 22*a*, first drive wheel 20*a* continues to advance one step per day so that the front of eye 60 moves away from pin 58. At the change to the 29th, tooth 56 of 28-day wheel 54 passes over month wheel set 24 without being able to actuate leap-year adjustment wheel set 26. Then, at the change to the 30th, tooth 52 of 29-day wheel 50 also passes over month wheel set 24 without being able to actuate leap-year adjustment wheel set 26. At the same time, first drive wheel 20*a* advances in succession one step to drive first date programme wheel set 3*a* and to display the 29th, then the 30th by means of third lower tens disc 1*a* and first lower units disc 2*a*. At the change from the 30th to the 1st of the following month, tooth 48 of 30-day wheel 46 meshes with the tooth of 30-day month wheel 32, so that month wheel set 24 advances one step to display the following month. By advancing one step, month wheel set 24 with its month wheel 30 drives tooth 44 of month change wheel 42 so that second drive wheel 20*b* is restarted, driving second date programme wheel set 3*b* to display the 1st day of the following month by means of fourth upper tens disc 1*b* and second upper units disc 2*b*. The change from the 30th to the 1st day of the following month is thus achieved by a single jump of fourth upper tens disc 1*b* and of second upper units disc 2*b*, with the date numeral 1 appearing in the aperture in place of 30 instantaneously and with no transition period. Pin 58 is also driven again. First drive wheel 20*a*, which, until now was still being driven by drive pinion 22*a*, has also advanced so that its notch 28 arrives at the level of said drive pinion 22*a*. Thus, during the following days, first drive wheel 20*a* is stopped in the waiting position, as is first date programme wheel set 3*a*. Second drive wheel 20*b* advances one step per day, driving pin 58, which gradually moves closer to the front of eye 60 until it comes into contact with said eye 60 three days later in order to advance first drive wheel 20*a* one step; drive wheel 20*a* then starts again, driven by drive pinion 22*a*. The two drive wheels 20*a* and 20*b* then start to move again.

If the current month is a month of 31 days, month wheel set 24 is positioned such that leap-year adjustment wheel set 26 is remote from teeth 52 and 56, such that the teeth of 30-day month wheel 32 are remote from tooth 48 and such that the tooth of the current month of month wheel 30 can cooperate with tooth 44. From the 28th of the month, second drive wheel 20*b*, month change wheel 42 and its tooth 44 and pin 58 are stopped as described above. Under the action of drive pinion 22*a*, first drive wheel 20*a* continues to advance one step per day so that the front of eye 60 moves away from pin 58. At the change from the 29th to the 30th and then to the 31st, in succession, tooth 56 of 28-day wheel 54, then tooth 52 of 29-day wheel 50 pass over month wheel set 24 without being able to actuate leap-year adjustment wheel set 26, then tooth 48 of 30-day wheel 46 passes in front of 30-day month wheel 32 without being able to actuate it. At the same time, first drive wheel 20*a* advances, in succession, one step to drive first date programme wheel set 3*a* in order to display the 29th, then the 30th, then the 31st by means of third lower tens disc 1*a* and first lower units disc 2*a*. When first drive wheel 20*a* advances, the back of eye 60 gradually moves closer to pin 58 until it comes into contact therewith on the 31st. At the change from the 31st to the 1st of the following month, first drive wheel 20*a* advances one step again under the action of drive pinion 22*a* so that it causes pin 58 to rest against the back of eye 60. The driving of pin 58 causes the month change wheel, its tooth 44 and second drive wheel 20*b* to start again and advance one step, so that tooth 44 of month change wheel 42 meshes with the tooth of month wheel 30 in order to advance month wheel set 24 one step to display the following month. Once restarted, second drive wheel 20*b* drives second date programme wheel set 3*b* to display the 1st day of the following month by means of fourth upper tens disc 1*b* and second upper units disc 2*b*. The change from the 31st to the 1st day of the following month is thus achieved by a single jump of fourth upper tens disc 1*b* and of second upper units disc 2*b*, with the date numeral 1 appearing in the aperture in place of 31 instantaneously and with no transition period. As first drive wheel 20*a* has advanced, its notch 28 arrives at the level of said drive pinion 22*a*. Thus, during the following days, first drive wheel 20*a* is stopped in the waiting position, as is first date programme wheel set 3*a*. Second drive wheel 20*b* advances one step per day, driving pin 58, which gradually moves closer to the front of eye 60 until it comes into contact with said eye 60 three days later in order to advance first drive wheel 20*a* one step; drive wheel 20*a* then starts again, driven by drive pinion 22*a*. The two drive wheels 20*a* and 20*b* then start to move again. The eye 60/pin 58 system makes it possible to obtain a 31-day cycle with two drive wheels 20*a*, 20*b* having 28 teeth.

On the 28th of February, in the case of a non-leap-year, month wheel set 24 is positioned such that the teeth of 30-day month wheel 32 are remote from tooth 48 and such that the February tooth of month wheel 30 can cooperate with tooth 44. Leap year adjustment wheel set 26 is positioned such that a finger of non-leap-year wheel 38 can cooperate with tooth 56 of 28-day wheel 54, the finger of leap-year wheel 40 then being remote from tooth 52 of 29-day wheel 50. Like the 28th of every other month, since second drive wheel 20*b* is in the waiting position, month change wheel 42, its tooth 44 and pin 58 are stopped as described above. At the change from the 28th February to the 1st of March, under the action of drive pinion 22*a*, first drive wheel 20*a* continues to advance so that tooth 56 of 28-day wheel 54 meshes with the finger of non-leap-year wheel 38 causing leap-year adjustment wheel set 26, and therefore month wheel 24, to advance one step to display the month of March. By advancing one step, month wheel set 24 with its month wheel 30 drives tooth 44 of month change wheel 42 so that second drive wheel 20*b* is restarted, driving second date programme wheel set 3*b* to display the 1st day of March by means of fourth upper tens disc 1*b* and second upper units disc 2*b*. The change from the 28th of February to the 1st of March is thus achieved by a single jump of fourth upper tens disc 1*b* and of second upper units disc 2*b*, with the first of March appearing in the aperture in place of the 28th of February instantaneously and with no transition period. Pin 58 is already in position against the front of eye 60, so that three days later, when notch 28 of first drive wheel 20*a* arrives at the level of drive pinion 22*a* and moves into the waiting position, second drive wheel 20*b* drives pin 58 against the front of the eye in order to restart first drive wheel 20*a*. The two drive wheels 20*a* and 20*b* then start to move again.

As month wheel set 24 makes one revolution per year about finger 36, Maltese cross 34 makes one quarter-turn per year, so that the fingers of non-leap-year wheel 38 act on tooth 56 as described above for three years. The fourth year corresponds to a leap year. Maltese cross 34 has then made a last quarter-turn so that it is the finger of leap-year wheel 40 that can cooperate with tooth 52 of 29-day wheel 50. The fingers of non-leap-year wheel 38 are then remote from tooth 56 of 28-day wheel 54.

Consequently, on the 28th of February, in the case of a leap year, month wheel set 24 is positioned such that the teeth of 30-day month wheel 32 are remote from tooth 48 and such that the February tooth of month wheel 30 can cooperate with tooth 44. As described above, leap-year adjustment wheel set 26 is positioned such that the finger of leap-year wheel 40 can cooperate with tooth 52 of 29-day wheel 50, the fingers of non-leap-year wheel 38 then being remote from tooth 56 of 28-day wheel 54. Like the 28th of every other month, since second drive wheel 20*b* is in the waiting position, month change wheel 42, its tooth 44 and pin 58 are stopped as described above. Under the action of drive pinion 22*a*, first drive wheel 20*a* continues to advance one step per day. At the change to the 29th of February, tooth 56 of 28-day wheel 54 passes in front of non-leap-year wheel 38 without being able to actuate it. At the same time, first drive wheel 20*a* advances one step to drive first date programme wheel set 3*a* to display the 29th by means of third lower tens disc 1*a* and first lower units disc 2*a*. At the change from the 29th of February to the 1st of March, it is tooth 52 of 29-day wheel 50 that meshes with the finger of non-leap-year wheel 40 causing leap-year adjustment wheel set 26, and therefore month wheel 24, to advance one step to display the month of March. By advancing one step, month wheel set 24 with its month wheel 30 drives tooth 44 of month change wheel 42 so that second drive wheel 20*b* is restarted, driving second date programme wheel set 3*b* to display the 1st day of March by means of fourth upper tens disc 1*b* and second upper units disc 2*b*. The change from the 29th of February to the 1st of March is thus achieved by a single jump of fourth upper tens disc 1*b* and of second upper units disc 2*b*, with the first of March appearing in the aperture in place of the 29th of February instantaneously and with no transition period. Pin 58, which had moved away from the front of eye 60 while second drive wheel 20*b* was stopped, returns to its position against the front of eye 60 three days later, when notch 28 of first drive wheel 20*a* arrives at the level of drive pinion 22*a* and moves into the waiting position, and second drive wheel 20*b* drives pin 58 against the front of the eye in order to restart first drive wheel 20*a*. The two drive wheels 20*a* and 20*b* then start to move again.

Thus, the calendar mechanism according to the invention can control the driving of the first 3*a* and second 3*b* date programme wheel sets so that the display of the 28th on the last day of the month is performed by first date programme wheel set 3*a* and the display of the first day of the following month is performed by second date programme wheel set 3*b*, the change between the last day of the month and the first day of the following month occurring by a single jump of fourth upper tens disc 1*b* and of second upper units disc 2*b* appearing instantaneously and with no transition period in the aperture in place of third upper tens disc 1*a* and first lower units disc 2*a*.

Moreover, the calendar mechanism according to the invention provides a date display wherein the tens numeral and the units numeral are on the same level for 25 out of 31 days. This makes it possible to obtain a very attractive calendar display, particularly suitable for a large date display.

Further, the calendar mechanism according to the invention has the advantage of being bidirectional.

Referring to FIGS. 11 to 14, there is represented a second variant of the invention, wherein the calendar mechanism is a secular perpetual calendar mechanism for managing the years 2100, 2200 and 2300, which are not actually leap years, but which, by exception, are non-leap years. Thus, the mechanism according to this second variant of the invention will not require adjustment in 2100, 2200 or 2300, unlike a conventional perpetual calendar mechanism.

The secular perpetual calendar mechanism comprises the same date-discs 1*a*, 1*b*, 2*a*, 2*b*, the same date programme unit 3 and the same drive member 5 as described above for the first variant. In the following description, the elements common to the first variant are referred to by the same reference numbers. The drive unit is slightly modified in order to manage the non-leap years 2100, 2200 and 2300.

Figure 12:
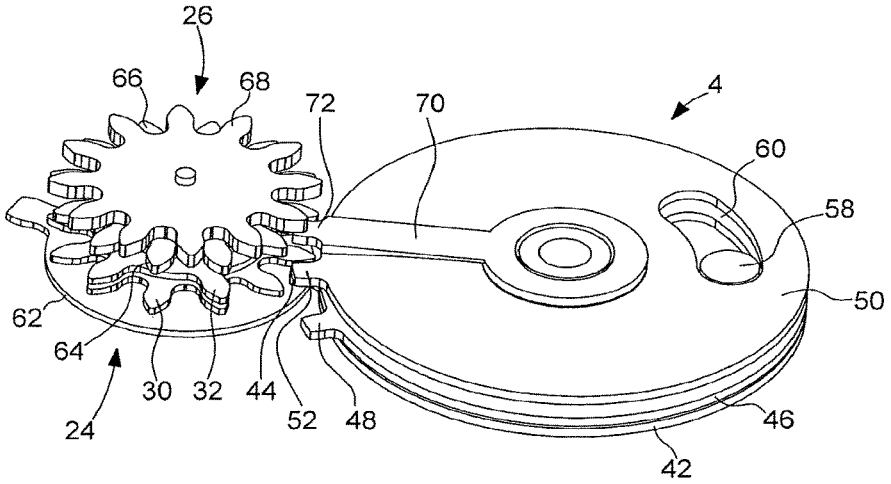
FIG. 12 is an isometric top view of the drive unit, of the month wheel set and of the leap-year adjustment mechanism according to the second variant.
Figure 13:
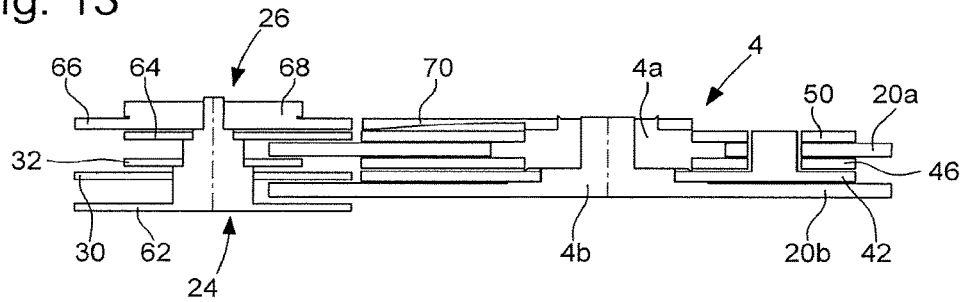
FIG. 13 is a cross-sectional view along line C-C of FIG. 11.

Thus, referring more particularly to FIGS. 12 and 13, month wheel set 24 comprises, according to the second variant, a year wheel 62 comprising a finger, month wheel 30, 30-day month wheel 32 and a February wheel 64 having a single tooth corresponding to February and arranged to be superposed on the tooth corresponding to February of month wheel 30. Said wheels 62, 30, 32 and 64 of the month wheel set are coaxially mounted on the arbor of month wheel set 24 and integral with each other.

In this variant, leap-year adjustment mechanism 26 comprises a leap-year adjustment wheel having a first lower toothing 66 and a second upper toothing 68; said first 66 and second 68 toothings are shifted by one step with respect to each other. Leap-year adjustment mechanism 26 is pivotally mounted on the arbor of month wheel set 24.

Said month wheel set 24 and leap-year adjustment mechanism 26 are arranged to cooperate with drive unit 4 on the one hand, and, on the other hand, with a leap-year programme wheel 63 until at least 2300, as will be described below.

To this end, in this second variant, drive unit 4 or the month programme wheel comprises the first 20*a* and second 20*b* drive wheels which respectively mesh with first date drive wheel 14*a* of first date programme wheel set 3*a* and second date drive wheel 14*b* of second date programme wheel set 3*b*, as described above for the first variant. The construction layout is different however, given the additional elements required for managing leap years in the secular perpetual calendar.

Further, the month programme wheel comprises month change wheel 42 comprising tooth 44 arranged to mesh with month wheel 30 of month wheel set 24, 30-day wheel referenced 46 carrying tooth 48 arranged to be able to mesh with 30-day month wheel 32, 29-day wheel referenced 50 carrying tooth 52, arranged here to be able to mesh with the tooth of February wheel 64 of month wheel set 24, and a 28-day jumper referenced 70 carrying a tooth 72 arranged to mesh with first lower toothing 66 of the leap-year adjustment wheel when leap-year adjustment mechanism 26 is free to rotate in the leap years, and to be able to mesh with February wheel 64 of month wheel set 24 when leap-year adjustment mechanism 26 is locked in rotation by leap-year programme wheel 63 in the non-leap years. The 28-day jumper, and the 29-day and 30-day wheels are disposed such that tooth 52 of the 29-day wheel referenced 50 is shifted by one step with respect to tooth 72 of the 28-day jumper referenced 70, and tooth 48 of the 30-day wheel referenced 46 is shifted by one step with respect to tooth 52 of the 29-day wheel referenced 50.

Month change wheel 42 is joined to second drive wheel 20*b* via drive arbor 4*b* of second drive wheel 20*b*. The 30-day wheel referenced 46, the 29-day wheel referenced 50, the 28-day jumper referenced 70 and first drive wheel 20*a* are joined to each other via drive arbor 4*a* which is pivotally mounted on drive arbor 4*b*.

As in the first variant, month change wheel 42 carries a pin 58 towards first drive wheel 20*a*. The 30-day wheel referenced 46, 29-day wheel referenced 50, and first drive wheel 20*a* each have the oblong aperture 60 called an eye, which is arranged to receive pin 58 of month change wheel 42 and inside which said pin 58 can move when the motion of second drive wheel 20*b* is different from the motion of first drive wheel 20*a*, as described above.

The 28-day jumper referenced 70 is arranged with respect to month change wheel 42 such that on the 28th day of the month, tooth 72 of 28-day jumper 70 is aligned with tooth 44 of month change wheel 42, with said teeth 44 and 72 arriving at the level of month wheel set 24 and of leap-year adjustment wheel set 26.

Figure 14:
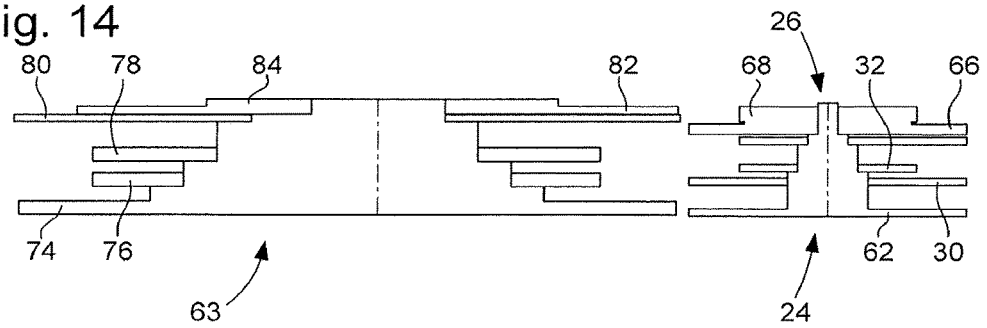
FIG. 14 is a cross-sectional view along line B-B of FIG. 11.

Referring more specifically to FIG. 14, leap-year programme wheel 63 comprises a year drive wheel 74 having 20 teeth, and arranged to cooperate, on the one hand, with year wheel 62 of month wheel set 24, and on the other hand, with a disc 75 displaying the units of the year, disc drive wheels 76, 78 controlling the display of the years, a year cam 80 arranged to lock the second upper toothing 68 of leap-year adjustment wheel 26 in the non-leap years, and to leave it free in the leap years (2000, 2004, 2008, 2012, 2016), year drive wheel 74, disc drive wheels 76, 78 controlling the year display, and year cam 80 being integral in rotation, and a century cam 82 pivotally and coaxially mounted on year cam 80 and arranged to take the place of year cam 80 and to lock second upper toothing 68 of leap-year adjustment wheel 26 in the non-leap years 2100, 2200 and 2300. Century cam 82 is integral with a drive wheel 84 having 20 teeth, kinematically connected to the movement to advance one step every 20 years so that century cam 82 makes one revolution every 400 years. As year cam 80 is integral with year wheel 62, it makes one revolution every 20 years. It has on its periphery five notches 86 corresponding to the leap years, for example 2000, 2004, 2008, 2012 and 2016. These notches 86 are arranged such that second upper toothing 68 of leap-year adjustment wheel 26 is free to rotate when it faces said notches 86 in the leap years, and such that the periphery of year cam 80 locks second upper toothing 68 of leap-year adjustment wheel 26 in the other, non-leap years. Century cam 82 has three protuberances 88, arranged to fill notches 86 of year cam 80 when said notch 86 corresponds to one of years 2100, 2200 or 2300, which are not leap years. In that case, since notch 86 is filled, second upper toothing 68 of leap-year adjustment wheel 26 will be locked for the protuberance 88 occupying notch 86, so that the mechanism will behave as for a non-leap year.

Figure 11:
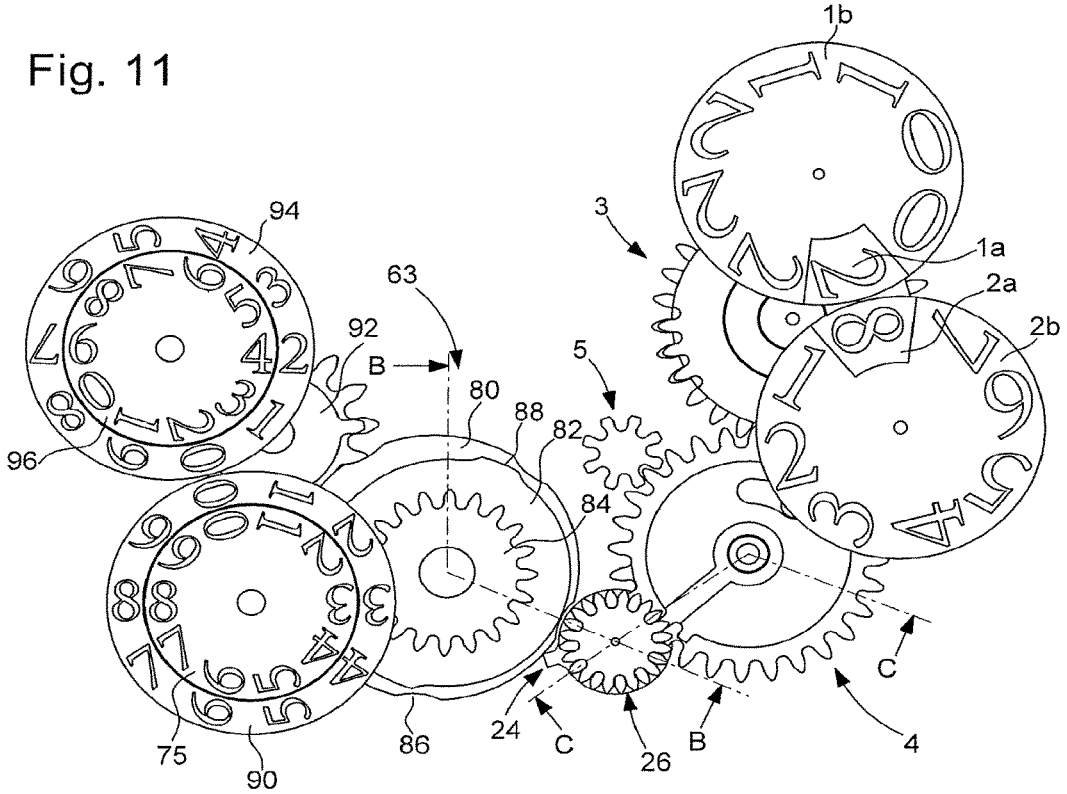
FIG. 11 is a top view of a second variant of the calendar mechanism according to the invention.

Referring to FIG. 11, drive wheel 76 is arranged to drive a disc 90 displaying the tens of the year, which is pivotally and coaxially mounted coaxially about disc 75 displaying the units of the year. Drive wheel 78 is arranged to drive an intermediate drive wheel set 92, arranged to drive, on the one hand, a disc 94 displaying the hundreds of the year, and on the other hand, a disc 96 displaying the thousands of the year 96.

The secular perpetual calendar mechanism operates as follows: on the 28th of February, like the 28th of every other month, as described above for the first variant, second drive wheel 20*b* is in the waiting position, and month change wheel 42, its tooth 44 and pin 58 are stopped as already described above. Month wheel set 24 is positioned such that the teeth of 30-day month wheel 32 are remote from tooth 48 of 30-day wheel 46, such that the February tooth of month wheel 30 can cooperate with tooth 44, and such that the tooth of February wheel 64 can cooperate with tooth 52 of 29-day wheel 50. The 28-day jumper is positioned such that its tooth 72 is ready to cooperate with first lower toothing 66 of leap-year adjustment wheel 26.

In a leap year, year cam 80 is disposed such that a notch 86 is facing second upper toothing 68 of leap-year adjustment wheel 26. Thus, leap-year adjustment mechanism 26 is free to rotate.

As described in the first variant, under the action of drive pinion 22*a*, first drive wheel 20*a* continues to advance one step per day. At the change to the 29th of February, tooth 72 of 28-day jumper 70 meshes with first lower toothing 66 of leap-year adjustment wheel 26, which rotates on itself since it is free in rotation. 28-day jumper 70 is therefore inactive. At the same time, first drive wheel 20*a* advances one step to drive first date programme wheel set 3*a* to display the 29th by means of third lower tens disc 1*a* and first lower units disc 2*a*, as described above. At the change from the 29th of February to the 1st of March, it is tooth 52 of 29-day wheel 50 that meshes with the tooth of February wheel 64, causing month wheel set 24 to advance one step to display the month of March. By advancing one step, month wheel set 24 with its month wheel 30 drives tooth 44 of month change wheel 42 so that second drive wheel 20*b* is restarted, driving second date programme wheel set 3*b* to display the 1st day of March by means of fourth upper tens disc 1*b* and second upper units disc 2*b*. Year wheel 62 also advances one step. Pin 58 works inside eye 60 in the same way as described above for the first variant.

In the case of a non-leap year, year cam 80 is disposed such that it is the periphery of the cam that is in contact with second upper toothing 68 of leap-year adjustment wheel 26. Thus, leap-year adjustment mechanism 26 is locked and cannot rotate.

At the change from the 28th February to the 1st of March, under the action of drive pinion 22*a*, first drive wheel 20*a* continues to advance so that tooth 72 of 28-day jumper 70 attempts to mesh with first lower toothing 66 of leap-year adjustment wheel 26. Since the latter is locked in rotation, 28-day jumper 70 is active, such that, due to the inclined plane of the teeth of first lower toothing 66, 28-day jumper 70 slides down to the lower level corresponding to the tooth of February wheel 64. 28-day jumper 70 then meshes with the tooth of February wheel 64, causing month wheel set 24 to advance one step to display the month of March. As described above for the first variant, by advancing one step, month wheel set 24, with its month wheel 30, drives tooth 44 of month change wheel 42 so that second drive wheel 20*b* is restarted, driving second date programme wheel set 3*b* to display the 1st day of March by means of fourth upper tens disc 1*b* and second upper units disc 2*b*. Pin 58 works inside eye 60 in the same way as described above for the first variant.

Once February has passed, as month wheel set 24 has pivoted, the tooth of February wheel 64 has thus moved away from tooth 52 of 29-day wheel 50 and from tooth 72 of 28-day jumper 70. Thus, tooth 52 of 29-day wheel 50 is no longer active in the other months, and in the case of a non-leap year, 28-day jumper 70 is no longer active in the other months.

As a result of the rotation once per month of month wheel set 24, year wheel 62 advances one step per month and thus drives leap-year programme wheel 63 once per year via year drive wheel 74. Year drive wheel 74 itself drives year cam 80 and drive wheels 76 and 78 in order to advance the year display on discs 75, 90, 94 and 96. Year cam 80 advances one step per year, so that another notch 86 appears facing leap-year adjustment mechanism 26 every four years, corresponding to a leap year and to the implementation of the mechanism described above in leap years. At the same time, century cam 82 is controlled by drive wheel 84 and advances one step every 20 years. Thus, when the non-leap year 2100, 2200 or 2300 arrives, the notch 86 facing leap-year adjustment mechanism 26 will be filled by a protuberance 88 of century cam 82, such that second upper toothing 68 of leap-year adjustment mechanism 26 will be locked. Thus, the mechanism will behave as for a non-leap year.

This second variant has the same advantages as the first variant.

Figure 15:
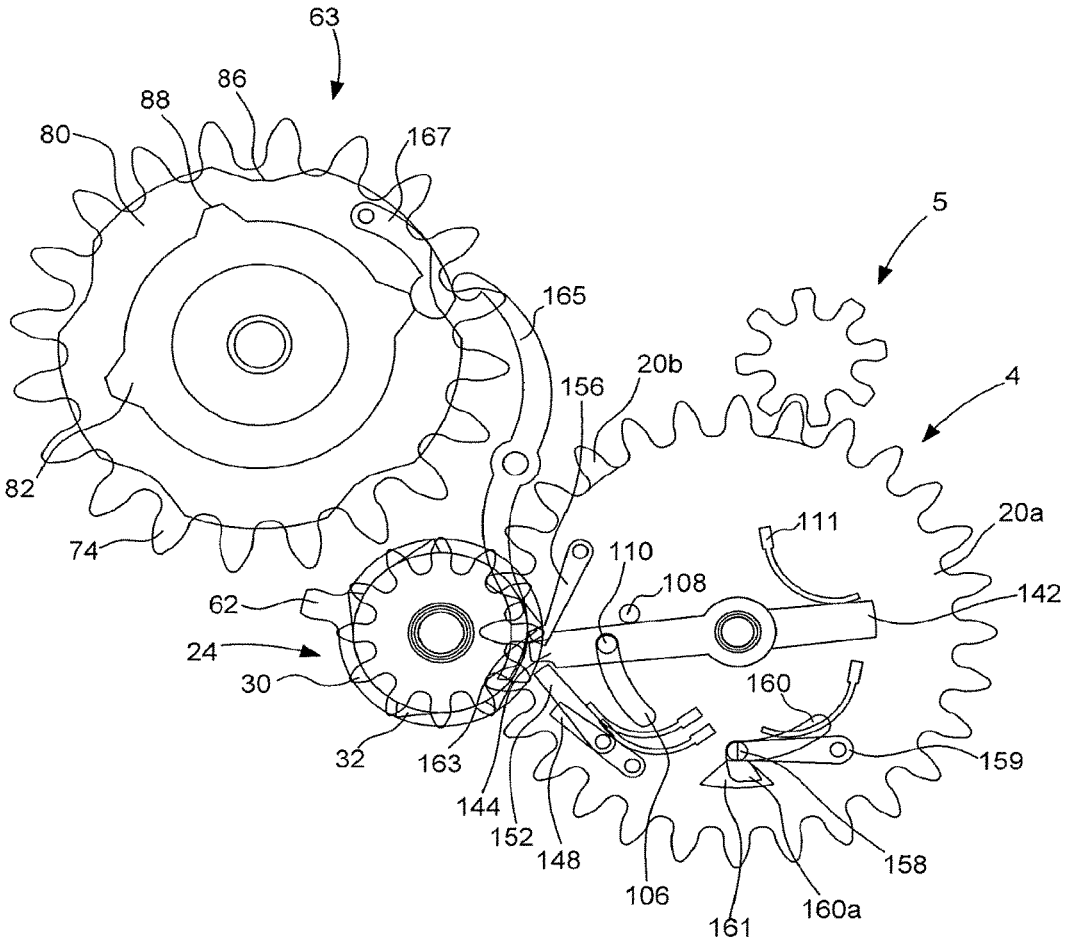
FIG. 15 is a top view of the drive unit, of the month wheel set, of the leap-year adjustment mechanism and of the leap-year programme wheel according to another embodiment of the second variant.

FIG. 15 represents another embodiment of this second variant. In this other embodiment, drive unit 4, leap-year adjustment mechanism 26, month wheel set 24 and leap-year programme wheel 63 are of different construction from that of the embodiment of FIGS. 11 to 14; the other elements are identical. This construction comprises, in particular, various safety systems for avoiding date display errors when a backward correction is made.

More particularly, in drive unit 4, teeth 48, 52 and 56 are similar here to teeth 48, 52, 56 of the first variant, but are respectively replaced by retractable teeth 148, 152 and 156 respectively mounted on their 30-day wheel, their 29-day wheel and their 28-day wheel (not represented). They are held by jumpers. Retractable teeth 148, 152 and 156 and the month wheel set teeth are arranged such that teeth 148, 152 and 156 retract on contact with the month wheel set in case of backward correction, in order not to drive the month wheel set and risk an incorrect display of the month. Thus, retractable teeth 148, 152 and 156 constitute a first safety system in case of backward correction.

Month change wheel 42 and its tooth 44 are replaced by a month change finger 142 ending in a tooth 144 arranged to mesh with month wheel 30 of month wheel set 24. This finger 142 is pivotally mounted with respect to second drive wheel 20*b* in order to permit disassembly of these two elements when a backward correction of the date is necessary. The movement of finger 142 with respect to second drive wheel 20*b*, so that one can or cannot drive the other, is controlled by means of a system with an eye 106, pins 108 and 110, and a jumper 111. Pin 110 is integral with finger 142 and is arranged to move inside eye 106 arranged in first drive wheel 20*a*. Pin 108 is integral with second drive wheel 20*b* and can hold finger 142 under stress. This mechanism constitutes a second safety system and, in case of backward correction, can uncouple finger 142 from second drive wheel 20*b* in order not to drive the date discs and risk an incorrect display of the date.

Drive unit 4 comprises a third safety system allowing the first and second drive wheels 20*a*, 20*b* to be joined in the case of backward correction. This system replaces eye 60 and pin 58 of the preceding embodiments. It comprises a pin 158 fixed on a lever 159 which is pivotally mounted on second drive wheel 20*b* and held by a jumper. Pin 158 is arranged to move inside an eye 160 arranged in first drive wheel 20*a*, and in the 28-day, 29-day and 30-day wheels. Eye 160 has a catch 160*a* in which pin 158 gets into position in order to restart first drive wheel 20*a* three days after the beginning of the month, as described above. Further, catch 160*a* forms a locking member allowing the first and second drive wheels 20*a*, 20*b* to be joined to each other once they are rotating synchronously. There is arranged on the frame a stud 161, arranged to remove pin 158 from catch 160*a* when pin 158 positioned inside said catch 160*a* arrives opposite stud 161 on the 28th of the month and to uncouple first and second drive wheels 20*a*, 20*b* and allow them to move out of sync at the end of the month and at the beginning of the month, as described above. This safety system allows the mechanism to operate normally and also allows the first and second drive wheels 20*a*, 20*b* to be joined to each other in case of backward correction, and a fast display correction to be made to change from the first of March to the 28th of February, for example, by means of a single jump.

In month wheel set 24, tooth 163 of the February wheel is arranged to be able to cooperate or mesh with tooth 156 and with tooth 152. In this embodiment, leap-year adjustment mechanism 26 is formed of a locking cam 165 pivotally mounted on the frame and arranged to cooperate, on the one hand, with year cam 80 or century cam 82 of leap-year programme wheel 63, and with retractable tooth 156, on the other hand. In a leap year, locking cam 165 drops into a notch 86 facing year cam 80, so as to push back retractable tooth 156, which can then no longer cooperate with tooth 163. Tooth 156 is then inactive at the change from the 28th to the 29th, as in the first embodiment of the second variant described above. In a non-leap year, locking cam 165 cooperates with the "normal" periphery of year cam 80, so that locking cam 165 has rocked, allowing retractable tooth 156 to return to the active position to cooperate with tooth 163 at the change from the 28th of February to the 1st of March. Tooth 163 and tooth 156 then operate like the finger of non-leap year wheel 38 and tooth 56 of the first variant described above.

To manage the non-leap years 2100, 2200 or 2300, a lever 167 is provided, pivotally mounted on year cam 80. Century cam 82 comprises the three protuberances 88, arranged to lift lever 167 when a protuberance 88 arrives opposite said lever 167. Lever 167 then pivots to rock locking cam 165 into the same position as if it were cooperating with the "normal" periphery of the year cam. Thus, locking cam 165 has rocked to allow retractable tooth 156 to return to the active position in order to cooperate with tooth 163 as though it were a non-leap year.

The operation of teeth 148 and 152 is similar to that of teeth 48 and 52.

What is claimed is:

1. A calendar mechanism for a timepiece comprising a date display with date-discs, a date programme unit arranged to drive the date-discs, a drive unit arranged to drive the date programme unit and a drive member of the timepiece arranged to actuate the drive unit, wherein the date-discs comprise a first lower units disc and a second upper units disc, which are superposed and free to rotate with respect to each other and a third lower tens disc and a fourth upper tens disc, which are superposed and free to rotate with respect to each other, the first lower units disc being divided into eight sectors occupied by the numerals 8, 9, 0 and 1, the second upper units disc being divided into eight sectors, of which seven sectors are occupied by the numerals from 1 to 7 and one sector is occupied by an aperture revealing one of the numerals borne by the first lower units disc, the third lower tens disc being divided into eight sectors occupied by the numerals 2 and 3, the fourth upper tens disc being divided into eight sectors, of which seven sectors are occupied by the numerals 0, 1 and 2, and one sector is occupied by an aperture revealing one of the numerals borne by the third lower tens disc, and wherein the date programme unit comprises a first date programme wheel set for actuating the first lower units disc and the third lower tens disc, and a second date programme wheel set for actuating the second upper units disc and the fourth upper tens disc, said first and second date programme wheel sets being arranged to mesh selectively with the date-discs so that the last day of the month is displayed with the third lower tens disc and the first lower units disc and the first day of the following month is displayed with the fourth upper tens disc and the second upper units disc, the change of date between two consecutive months occurring via a single jump of the fourth upper tens disc and of the second upper units disc, regardless of the month.

2. The calendar mechanism according to claim 1, wherein the drive unit comprises a first drive wheel arranged to drive the first date programme wheel set and a second drive wheel arranged to drive the second date programme wheel set, and wherein the drive member comprises a first drive pinion meshing with the first drive wheel and a second drive pinion meshing with the second drive wheel.

3. The calendar mechanism according to claim 2, wherein the mechanism further comprises a month wheel set and a leap-year adjustment mechanism arranged to cooperate with the drive unit, and wherein the drive unit is a month programme wheel incorporating the first drive wheel and the second drive wheel, so that the calendar mechanism is a perpetual calendar mechanism.

4. The calendar mechanism according to claim 3, wherein the first drive wheel, respectively the second drive wheel, has 28 teeth, one of which is missing to form a notch defining a waiting position in which the first drive wheel, respectively the second drive wheel, is not driven by the drive member.

5. The calendar mechanism according to claim 3, wherein the month wheel set comprises a month wheel integral with a 30-day month wheel and wherein the leap-year adjustment mechanism is a leap-year adjustment wheel set comprising a non-leap year wheel and a leap year wheel.

6. The calendar mechanism according to claim 5, wherein the month programme wheel comprises, in addition to the first drive wheel and the second drive wheel that respectively mesh with the first date programme wheel and the second date programme wheel, a month change wheel comprising a tooth arranged to mesh with the month wheel of the month wheel set, said month change wheel being integral with the second drive wheel and carrying a pin, a 28-day wheel carrying a tooth arranged to be able to mesh with the non-leap year wheel of the leap-year adjustment wheel set, the 28-day wheel being arranged to with respect to the month change wheel such that on the 28th of the month, the tooth of the 28-day wheel is aligned with the tooth of the month change wheel, a 29-day wheel carrying a tooth arranged to be able to mesh with the leap-year wheel of the leap-year adjustment wheel set, the tooth of the 29-day wheel being shifted by one step with respect to the tooth of the 28-day wheel, and a 30-day wheel carrying a tooth arranged to be able to mesh with the 30-day month wheel, the tooth of the 30-day wheel being shifted by one step with respect to the tooth of the 29-day wheel, the 30-day wheel, the 29-day wheel, the 28-day wheel and the first drive wheel being integral with each other and each having an oblong aperture arranged to receive the pin of the month change wheel.

7. The calendar mechanism according to claim 5, wherein the leap-year adjustment wheel set and a Maltese cross integral in rotation with said leap-year adjustment wheel set are pivotally mounted on the month wheel set, the Maltese cross being actuated by a fixed finger about which said Maltese cross rotates, carried by the month wheel set.

8. The calendar mechanism according to claim 3, wherein the month wheel set comprises, integral with each other, a year wheel, a month wheel, a 30-day month wheel, and a February wheel, and wherein the leap-year adjustment mechanism comprises a leap-year adjustment wheel having a first lower toothing and a second upper toothing, said first lower toothing and second upper toothing being shifted by one step with respect to each other, the leap-year adjustment mechanism being arranged to cooperate with a leap-year programme wheel until at least 2300, so that the calendar mechanism is a secular perpetual calendar mechanism.

9. The calendar mechanism according to claim 8, wherein the month programme wheel comprises, in addition to the first drive wheel and the second drive wheel that respectively mesh with the first date programme wheel and the second date programme wheel, a month change wheel comprising a tooth arranged to mesh with the month wheel of the month wheel set, said month change wheel being integral with the second drive wheel and carrying a pin, a 28-day jumper carrying a tooth arranged to mesh with the first lower toothing of the leap-year adjustment wheel when the leap-year adjustment mechanism is free to rotate in the leap years, and to be able to mesh with the February wheel of the month wheel set when the leap-year adjustment mechanism is locked in rotation by the leap-year programme wheel in the non-leap years, a 29-day wheel carrying a tooth arranged to be able to mesh with the February wheel, the tooth of the 29-day wheel being shifted by one step with respect to the tooth of the 28-day jumper, a 30-day wheel carrying a tooth arranged to be able to mesh with the 30-day month wheel, the tooth of the 30-day wheel being shifted by one step with respect to the tooth of the 29-day wheel, the 28-day jumper being arranged with respect to the month change wheel such that, on the 28th of the month, the tooth of the 28-day jumper is aligned with the tooth of the month change wheel, the 30-day wheel, the 29-day wheel, the 28-day jumper and the first drive wheel being integral in rotation with each other and the 30-day wheel, the 29-day wheel and the first drive wheel each having an oblong aperture arranged to receive the pin of the month change wheel.

10. The calendar mechanism according to claim 8, wherein the leap year programme wheel comprises a year drive wheel arranged to cooperate with the year wheel of the month wheel set, drive wheels for discs controlling the display of the year, a year cam arranged to lock the second upper toothing of the leap-year adjustment wheel in the non-leap years and to leave said upper toothing free in the leap years, the year drive wheel, the drive wheels for the discs controlling the display of the year, and the year cam being integral in rotation, and a century cam pivotally mounted on the year cam and arranged to take the place of the year cam and to lock the second upper toothing of the leap-year adjustment wheel in the non-leap years 2100, 2200 and 2300.

11. The calendar mechanism according to claim 3, wherein the month wheel set comprises, integral with each other, a year wheel, a month wheel, a 30-day month wheel, and a February wheel having a single tooth, and wherein the leap-year adjustment mechanism comprises a locking cam arranged to cooperate with a leap-year programme wheel until at least 2300, so that the calendar mechanism is a secular perpetual calendar mechanism.

12. The calendar mechanism according to claim 11, wherein the month programme wheel comprises, in addition to the first drive wheel and the second drive wheel that respectively mesh with the first date programme wheel and the second date programme wheel, a month change finger ending in a tooth arranged to mesh with the month wheel of the month wheel set, said month change finger being arranged to be uncouplable from the second drive wheel, a 28-day wheel carrying a retractable tooth arranged to be able to cooperate with the locking cam so that said tooth of the 28-day wheel can or cannot cooperate with the tooth of the February wheel, a 29-day wheel carrying a retractable tooth arranged to be able to mesh with the tooth of the February wheel, and a 30-day wheel carrying a retractable tooth arranged to be able to mesh with the 30-day month wheel.

13. The calendar mechanism according to claim 12, wherein the leap-year programme wheel comprises a year cam arranged to actuate the locking cam and a century cam arranged to take the place of the year cam and to actuate the locking cam in the non-leap years 2100, 2200 and 2300.

14. The calendar mechanism according to claim 1, wherein the first date programme wheel set comprises a first date drive wheel meshing at least indirectly with the drive unit, a lower tens wheel meshing at least indirectly with a pinion integral with the third lower tens disc and a lower units wheel meshing at least indirectly with a pinion integral with the first lower units disc, and wherein the second date programme wheel set comprises a second date drive wheel meshing at least indirectly with the drive unit, an upper tens wheel meshing at least indirectly with a pinion integral with the fourth upper tens disc and an upper units wheel meshing at least indirectly with a pinion integral with the second upper units disc.

15. A timepiece comprising an annual calendar mechanism according to claim 1.

* * * * *